US011053463B2

(12) United States Patent
Crossman et al.

(10) Patent No.: US 11,053,463 B2
(45) Date of Patent: Jul. 6, 2021

(54) METHOD OF DELIVERING A LAUNDRY COMPOSITION

(71) Applicant: Conopco, Inc., Englewood Cliffs, NJ (US)

(72) Inventors: Martin Charles Crossman, Merseyside (GB); Geraint Paul Roberts, Cheshire (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 16/485,357

(22) PCT Filed: Jan. 24, 2018

(86) PCT No.: PCT/EP2018/051673

§ 371 (c)(1),
(2) Date: Aug. 12, 2019

(87) PCT Pub. No.: WO2018/145896

PCT Pub. Date: Aug. 16, 2018

(65) Prior Publication Data

US 2019/0382694 A1 Dec. 19, 2019

(30) Foreign Application Priority Data

Feb. 13, 2017 (EP) ..... 17155863

(51) Int. Cl.
*C11D 11/00* (2006.01)
*C11D 3/00* (2006.01)
*C11D 3/37* (2006.01)

(52) U.S. Cl.
CPC ..... *C11D 11/0017* (2013.01); *C11D 3/0015* (2013.01); *C11D 3/373* (2013.01)

(58) Field of Classification Search
None
See application file for complete search history.

(56) References Cited

U.S. PATENT DOCUMENTS 6,240,953 B1 * 6/2001 Laughlin ..... A47L 15/4436 137/268
6,750,191 B2 * 6/2004 Kasturi ..... C11D 3/162 510/417
6,949,498 B2 * 9/2005 Murphy ..... C11D 1/02 510/327
7,407,293 B2 * 8/2008 Ishii ..... G03B 21/16 348/748
8,304,375 B1 6/2012 Wolff et al.
2002/0077265 A1 * 6/2002 Buzzacarini ..... C11D 17/046 510/296
2002/0128170 A1 9/2002 DeClercq et al.
2003/0104969 A1 6/2003 Caswell et al.
2003/0220217 A1 11/2003 McHattie
2004/0016060 A1 1/2004 Detering et al.
2004/0033924 A1 2/2004 Murphy et al.
2004/0092425 A1 5/2004 Boutique et al.
2004/0103483 A1 6/2004 Delplancke et al.
2004/0107506 A1 6/2004 Detering et al.
2004/0121929 A1 6/2004 Wang et al.
2005/0250668 A1 11/2005 Serobian et al.
2006/0122088 A1 6/2006 Sadlowski et al.
2007/0105739 A1 5/2007 Wahl et al.
2007/0111914 A1 * 5/2007 Hsu ..... C11D 1/83 510/267
2007/0128142 A1 * 6/2007 Harrison ..... A61Q 19/00 424/70.12
2007/0163055 A1 7/2007 Delplancke et al.
2008/0009432 A1 1/2008 Caswell et al.
2009/0069522 A1 3/2009 Hessefort et al.
2009/0186798 A1 7/2009 Baston et al.
2010/0325812 A1 12/2010 Panandiker et al.
2010/0331229 A1 12/2010 Bianchetti et al.
2011/0039753 A1 2/2011 Cauvin et al.
2011/0111999 A1 5/2011 Smets et al.
2011/0240065 A1 10/2011 Panandiker et al.
2011/0277248 A1 11/2011 Panandiker et al.
2012/0004156 A1 1/2012 Panandiker et al.
2012/0071382 A1 3/2012 Wang et al.
2012/0309663 A1 12/2012 Panandiker et al.
2013/0232700 A1 * 9/2013 Smith ..... C11D 11/0017 8/137
2014/0023609 A1 1/2014 Mukherjee et al.
2014/0369943 A1 12/2014 Pilz et al.
2015/0330020 A1 11/2015 van Buskirk et al.

(Continued)

FOREIGN PATENT DOCUMENTS

CN 1332787 10/1999
CN 1277836 12/2000

(Continued)

OTHER PUBLICATIONS

IPRP2 in PCTEP2018053305; dated Jun. 4, 2019.
Written Opinion 2 in PCTEP2018053305.
Svensson, et al.; Surface Deposition and Phase Behavior of Oppositely Charged Polyion-Surfactant Ion Complexes. 2. A Means to Deliver Silicone Oil to Hydrophilic Surfaces; ACS Applied Materials & Interfaces; Jan. 27, 2010; XP055369144, pp. 143-156; vol. 2, No. 1.
S. Ugazio et al.; New Method for Direct Incorporation and Stabilization of Silicone Polymers in Fabric Softeners; SOFW Journal; 2007; pp. 48, 50-52, 54; XP001540614; vol. 133.
Search Report and Written Opinion in EP17155861; dated Aug. 4, 2017.

(Continued)

*Primary Examiner* — Katie L. Hammer
(74) *Attorney, Agent, or Firm* — Greenberg Traurig, LLP

(57) ABSTRACT

A method of delivering a laundry serum composition into the wash or rinse cycle, comprising the steps of: a. pouring a laundry liquid into a washing machine drawer, drum or a dosing shuttle; b. pouring a laundry serum composition on top of the laundry liquid; wherein the laundry serum composition comprises: a. 2-60 w.t. % benefit agent; b. less than 4 w.t. % surfactant; and c. water.

5 Claims, No Drawings

(56) References Cited

U.S. PATENT DOCUMENTS

| | | | | |
|---|---|---|---|---|
| 2016/0060574 | A1* | 3/2016 | Panandiker | C11D 11/0017 8/137 |
| 2016/0060575 | A1 | 3/2016 | Panandiker | |
| 2016/0168508 | A1 | 6/2016 | Ribaut et al. | |
| 2016/0296459 | A1 | 10/2016 | Sun et al. | |
| 2016/0348042 | A1* | 12/2016 | Schmiedel | D06F 35/006 |
| 2017/0335245 | A1 | 11/2017 | Burgess | |

FOREIGN PATENT DOCUMENTS

| | | | |
|---|---|---|---|
| CN | 1646760 | | 7/2005 |
| CN | 101657530 | | 2/2010 |
| CN | 103668989 | | 3/2014 |
| CN | 104487559 | | 4/2015 |
| CN | 105155257 | | 12/2015 |
| CN | 205653653 | | 10/2016 |
| CN | 110291180 | | 9/2019 |
| EP | 1080714 | | 3/2001 |
| JP | 10001874 | | 1/1998 |
| JP | 2000129577 | A | 5/2000 |
| WO | WO9839401 | | 9/1998 |
| WO | WO2000024856 | | 5/2000 |
| WO | WO2005079621 | A | 9/2005 |
| WO | WO2006088980 | | 8/2006 |
| WO | WO2008120176 | | 10/2008 |
| WO | WO2010120863 | | 10/2010 |
| WO | WO2013189010 | | 12/2013 |
| WO | WO2014079621 | | 5/2014 |
| WO | WO2015078692 | | 6/2015 |
| WO | WO2015078766 | | 6/2015 |
| WO | WO2018145895 | | 8/2018 |
| WO | WO2018145896 | | 8/2018 |
| WO | WO2018145897 | | 8/2018 |

OTHER PUBLICATIONS

Search Report and Written Opinion in EP17155838; dated Aug. 2, 2017.
Search Report and Written Opinion in EP17155805; dated Jul. 27, 2017.
Search Report and Written Opinion in EP17155812; dated Jul. 3, 2017.
Search Report and Written Opinion in EP17155863; dated Jun. 27, 2017.
Anonymous; Viscosity Tables; V&P Scientific Inc Internet article; 2010; pp. 1-4; XP055453259; www.vp-sci.com.
Search Report and Written Opinion in PCTEP2018051673; dated Mar. 5, 2018.
Search Report and Written Opinion in EP17155836; dated Aug. 2, 2017.
Search Report and Written Opinion in EP17155804; dated May 11, 2017.
Search Report and Written Opinion in PCTEP2018053305; dated Mar. 27, 2018.
Search Report and Written Opinion in PCTEp2018051674; dated Apr. 20, 2018.
Search Report and Written Opinion in PCTEP2018053030; dated Apr. 24, 2018.
Search Report and Written Opinion in PCTEP2018053289.
Search Report and Written Opinion in PCTEP2018051675.
Written Opinion 2 in PCTEP2018053030; dated Jan. 14, 2019.
Written Opinion 2 in PCTEP2018051672; dated Jan. 17, 2019.
Search Report and Written Opinion in PCTEP2018051672; dated Apr. 23, 2018.
Written Opinion in PTEP2018051675; dated Jan. 22, 2019.
Written Opinion 2 in PCTEP2018051674; dated Jan. 16, 2019.
IPRP2 in PCTEP2018051675; dated May 17, 2019.
IPRP2; dated May 9, 2019.

* cited by examiner

METHOD OF DELIVERING A LAUNDRY COMPOSITION

FIELD OF THE INVENTION

The present invention relates to a laundry serum providing improved performance of benefit agents.

BACKGROUND OF THE INVENTION

Consumers of laundry products constantly seek improvements in their products. It is desired for more fragrance, more softening, more cleaning etc. each consumer having their own desires.

Products currently on the market go some way towards delivering benefits to the consumer WO 2014/079621 discloses a laundry detergent composition comprising: surfactant, fabric softening silicone and cationic polysaccharide polymer. The invention is directed to a softening in the wash laundry composition.

However these are not an ideal solution, there remains a need enhance the benefits delivered to fabrics during the laundry process.

It has surprisingly been found that if a benefit agent is separated from a laundry liquid and delivered in a serum format, then the benefit agents provides superior performance, compared to delivery from a traditional laundry liquid.

SUMMARY OF THE INVENTION

In a first aspect of the present invention is laundry serum composition for use in the laundry process, the laundry serum composition comprising:

a. 2-60 w.t. % benefit agent;
b. less than 4 w.t. % surfactant; and
c. water wherein the laundry serum is used in addition to a laundry liquid.

In a second aspect of the present invention is provided a method of delivering a laundry serum composition into the wash or rinse cycle, comprising the steps of:

a. Pouring a laundry liquid into a washing machine drawer, drum or a dosing shuttle
b. Pouring a laundry serum composition according to any preceding claim on top of the laundry liquid In a third aspect of the present invention is provided a kit of parts comprising a laundry liquid and a laundry serum as disclosed herein.

DETAILED DESCRIPTION OF THE INVENTION

The term 'laundry liquid' is used to refer to traditional liquids used in the laundry process, particularly liquid laundry detergents and liquid laundry fabric conditioners/softener.

The term 'laundry serum' is used to refer to a specific format of laundry product. This is a liquid product which is used in addition to the laundry detergent and/or the fabric conditioner to provide an additional or improved benefit to the materials in the wash or rinse cycle. A serum is defined by its physical interaction with laundry liquids. A serum will float on the laundry liquid with which it is designed to be used. A serum may also be referred to as a liquid ancillary composition.

Throughout this specification density is measured by weighing a known volume of sample using a 'Sheen' density cup with lid on a 4 figure balance.

Throughout this specification viscosity measurements were carried out at 25° C., using a 4 cm diameter 2° cone and plate geometry on a DHR-2 rheometer ex. TA instruments.

In detail, all measurements were conducted using a TA-Instruments DHR-2 rheometer with a 4 cm diameter 2 degree angle cone and plate measuring system. The lower Peltier plate was used to control the temperature of the measurement to 25° C. The measurement protocol was a 'flow curve' where the applied shear stress is varied logarithmically from 0.01 Pa to 400 Pa with 10 measurement points per decade of stress. At each stress the shear strain rate is measured over the last 5 seconds of the 10 second period over which the stress is applied with the viscosity at that stress being calculated as the quotient of the shear stress and shear rate.

For those systems which exhibit a low shear viscosity plateau over large shear stress ranges, to at least 1 Pa, the characteristic viscosity is taken as being the viscosity at a shear stress of 0.3 Pa. For those systems where the viscosity response is shear thinning from low shear stress the characteristic viscosity is taken as being the viscosity at a shear rate of 21 s-1.

Serum Composition

The serum composition is an aqueous composition.

Benefit Agent

The present invention is concerned with a method of delivering a serum comprising a benefit agent. Benefit agents are materials which provide some form of benefit to the fabric. This benefit is normally a conceivable benefit which the consumers desire, for example effecting the feel, appearance, or perception of a fabric.

Non-limiting examples of suitable benefit agents include: lubricants (including silicones), antifoams, free perfumes and fragrances, encapsulated perfumes and fragrances, insect repellents, whiteness agents (eg shading or hueing dyes and/or fluorescers), preservatives (e.g. bactericides), enzymes (eg protease, lipases, cellulases, pectate lyase), dye transfer inhibitors, pH buffering agents, perfume carriers, anti-bacterial agenat, fibre adhesives (eg starch, Polyvinyl acetate), elastomers, anti-microbial agents, anti-redeposition agents, soil-release agents, softening agents, polyelectrolytes, anti-shrinking agents, anti-wrinkle agents, anti-oxidants, dyes, colorants, shade enhancers, fluorescent agents, sunscreens, anti-corrosion agents, anti-static agents, sequestrants (preferably HEDP, an abbreviation for Etidronic acid or 1-hydroxyethane 1,1-diphosphonic acid), colour preservatives, fungicides and ironing aids.

Preferred benefit agents are: lubricants (including silicones), fibre adhesives (eg starch, Polyvinyl acetate), elastomers, free perfumes and fragrances, encapsulated perfumes and fragrances and or perfume carriers, insect repellents, whiteness agents (eg shading or hueing dyes and/or fluorescers), enzymes (eg protease, lipases, cellulases, pectate lyase), dye transfer inhibitors, soil-release agents, anti-shrinking agents, anti-wrinkle agents, dyes (including colorants and/or shade enhancers), sunscreens (including UV filters), anti-static agents, sequestrants (preferably HEDP, an abbreviation for Etidronic acid or 1-hydroxyethane 1,1-diphosphonic acid) or polyelectrolytes.

Particularly preferred benefit agents include: lubricants, free perfumes and encapsulated perfumes. Most preferably silicones, free perfumes and encapsulated perfumes.

Lubricants:

Lubricants may be silicone based lubricants or non-silicone based lubricants.

Examples of non-silicone based lubricants include clays, waxes, polyolefins, sugar polyesters, synthetic and natural oils.

For the purposes of this invention, lubricants do not include fabric softening quaternary ammonium compounds.

Preferably the lubricant is a silicone based lubricant. Silicones and their chemistry are described in, for example in The Encyclopaedia of Polymer Science, volume 11, p 765.

Suitable silicones are fabric softening silicones. Non-limiting examples of such silicones include: non-functionalised silicones such as polydialkylsiloxanes, particularly polydimethylsiloxane (PDMS), alkyl (or alkoxy) functionalised silicones, and functionalised silicones or copolymers with one or more different types of functional groups such as amino, phenyl, polyether, acrylate, siliconhydride, carboxy acid, phosphate, betaine, quarternized nitrogen and mixtures thereof.

The molecular weight of the silicone is preferably from 1,000 to 500,000, more preferably from 2,000 to 250,000 even more preferably from 5,000 to 100,000.

The silicone composition of the current invention may be in the form of an emulsion or as a silicone fluid. In a preferred embodiment the silicone is in the form of a silicone emulsion.

When the silicone is in an emulsion, the particle size can be in the range from about 1 nm to 100 microns and preferably from about 10 nm to about 10 microns including microemulsions (<150 nm), standard emulsions (about 200 nm to about 500 nm) and macroemulsions (about 1 micron to about 20 microns).

The fabric softening silicones may be an emulsion or a fluid, preferably an emulsion.

Preferred non-functionalised silicones are polydialkylsiloxanes, most preferred non-functionalised silicones are polydimethylsiloxane (PDMS).

Preferred functionalised silicones are an anionic functionalised silicone. Examples of fabric softening anionic silicones suitable for the current invention include silicones containing the following functionalities; carboxylic, sulphate, sulphonic, phosphate and/or phosphonate functionality.

Preferably the anionic silicones of the current invention comprise silicones having a functionality selected from; carboxylic, sulphate, sulphonic, phosphate and/or phosphonate functionality or mixtures thereof. More preferably the anionic silicone of the present invention comprises carboxyl functionalised silicones. Most preferably the anionic silicone of the current invention is a carboxyl silicone.

For the purposes of the current invention, the anionic silicone may be in the form of the acid or the anion. For example for a carboxyl functionalised silicone, may be present as a carboxylic acid or carboxylate anion.

An example of a commercially available anionic functional material are: X22-3701E from Shin Etsu and Pecosil PS-100 from Pheonix Chemical.

Preferably the anionic silicone has an anionic group content of at least 1 mol %, preferably at least 2 mol %.

The anionic group(s) on the anionic silicones of the present invention are preferably located in pendent positions on the silicone i.e. the composition comprises anionic silicones wherein the anionic group is located in a position other than at the end of the silicone chain. The terms 'terminal position' and 'at the end of the silicone chain' are used to indicate the terminus of the silicone chain.

When the silicones are linear in nature, there are two ends to the silicone chain. In this case the anionic silicone preferably contains no anionic groups located on a terminal position of the silicone.

When the silicones are branched in nature, the terminal position is deemed to be the two ends of the longest linear silicone chain. Preferably no anionic functionality is not located on the terminus of the longest linear silicone chain.

Preferred anionic silicones are those that comprise the anionic group at a mid-chain position on the silicone. Preferably the anionic group(s) of the anionic silicone are located at least five Si atoms from a terminal position on the silicone. Preferably the anionic groups are distributed randomly along the silicone chain.

Most preferably the silicone of the present invention is selected from polydimethylsiloxane (PDMS) and carboxy functionalised silicones, preferred carboxy silicones are described above.

When a silicone is present, preferably the liquid ancillary laundry compositions comprises silicone at a level of 1 to 60 w.t % of the formulation, preferably 2 to 30 w.t. % of the formulation, more preferably 2.5 to 20 w.t. % of the formulation.

Perfumes:

The serum preferably comprises a perfume composition. Perfume may be provided either as a free oil and/or in a microcapsule.

The serum may comprise one or more perfume compositions. The perfume compositions may be in the form of a mixture or free perfumes compositions, a mixture of encapsulated perfume compositions or a mixture of encapsulated and free oil perfume compositions.

Useful perfume components may include materials of both natural and synthetic origin. They include single compounds and mixtures. Specific examples of such components may be found in the current literature, e.g., in Fenaroli's Handbook of Flavor Ingredients, 1975, CRC Press; Synthetic Food Adjuncts, 1947 by M. B. Jacobs, edited by Van Nostrand; or Perfume and Flavor Chemicals by S. Arctander 1969, Montclair, N.J. (USA). These substances are well known to the person skilled in the art of perfuming, flavouring, and/or aromatizing consumer products.

Free oil perfumes and fragrances may be added to the serum. These may be to scent the serum, to provide scent in the washing process or to provide scent to the textiles after the wash.

Particularly preferred perfume components are blooming perfume components and substantive perfume components. Blooming perfume components are defined by a boiling point less than 250° C. and a Log P greater than 2.5. Substantive perfume components are defined by a boiling point greater than 250° C. and a Log P greater than 2.5. Preferably a perfume composition will comprise a mixture of blooming and substantive perfume components. The perfume composition may comprise other perfume components.

It is commonplace for a plurality of perfume components to be present in a free oil perfume composition. In the compositions for use in the present invention it is envisaged that there will be three or more, preferably four or more, more preferably five or more, most preferably six or more different perfume components. An upper limit of 300 perfume ingredients may be applied.

Free perfume may preferably be present in an amount from 0.01 to 20% by weight, more preferably from 0.05 to 10% by weight, even more preferably from 0.1 to 5.0%, most preferably from 0.15 to 5.0% by weight, based on the total weight of the composition.

When perfume components are in a microcapsule, suitable encapsulating material, may comprise, but are not limited to; aminoplasts, proteins, polyurethanes, polyacrylates, polymethacrylates, polysaccharides, polyamides, polyolefins, gums, silicones, lipids, modified cellulose, polyphosphate, polystyrene, polyesters or combinations thereof.

Perfume components contained in a microcapsule may comprise odiferous materials and/or pro-fragrance materials.

Particularly preferred perfume components contained in a microcapsule are blooming perfume components and substantive perfume components. Blooming perfume components are defined by a boiling point less than 250° C. and a Log P greater than 2.5. Substantive perfume components are defined by a boiling point greater than 250° C. and a Log P greater than 2.5. Preferably a perfume composition will comprise a mixture of blooming and substantive perfume components. The perfume composition may comprise other perfume components.

It is commonplace for a plurality of perfume components to be present in a microcapsule. In the compositions for use in the present invention it is envisaged that there will be three or more, preferably four or more, more preferably five or more, most preferably six or more different perfume components in a microcapsule. An upper limit of 300 perfume ingredients may be applied.

Encapsulated perfume may preferably be present in an amount from 0.01 to 20% by weight, more preferably from 0.05 to 10% by weight, even more preferably from 0.1 to 5.0%, most preferably from 0.15 to 5.0% by weight, based on the total weight of the composition.

The serum may comprise one benefit agents or a combination of various different benefit agents.

The serum comprises at least 2 w.t. % benefit agents, preferably 2 w.t. % to 60 w.t. %. more preferably, 2.5 to 45 w.t. %, most preferably, 4 w.t. % to 40 w.t. % benefit agent. The w.t. % of benefit agent is the combined weight of all of the benefit agents in the serum composition.

If the serum comprises a microcapsules, a structurant may be required, non-limiting examples of suitable structurants include: pectine, alginate, arabinogalactan, carageenan, gellan gum, xanthum gum, guar gum, acrylates/acrylic polymers, water-swellable clays, fumed silicas, acrylate/aminoacrylate copolymers, and mixtures thereof. Preferred dispersants herein include those selected from the group consisting of acrylate/acrylic polymers, gellan gum, fumed silicas, acrylate/aminoacrylate copolymers, water-swellable clays, and mixtures thereof. Preferably a structurant is selected from acrylate/acrylic polymers, gellan gum, fumed silicas, acrylate/aminoacrylate copolymers, water-swellable clays, and mixtures thereof.

When present, a structurant is preferably present in an amount of 0.001-10 w.t. % percent, preferably from 0.005-5 w.t. %, more preferably 0.01-1 w.t. %.

Surfactant

The serum composition of the present invention is not a traditional laundry detergent or fabric conditioning composition. The present invention preferably comprises low levels or no surfactants. Any surfactant present is preferably for the purpose of emulsifying and not for detergency or softening.

The liquid ancillary composition comprises less than 4 w.t. % surfactant, preferably less than 2 w.t. % surfactant, more preferably less than 1 w.t. % surfactant, even more preferably less than 0.85 w.t. % surfactant and most preferably less than 0.5 w.t. %. The composition can be completely free of non-emulsified surfactant (ie surfactant not used to emulsify the droplet).

In other words, the compositions may comprise 0 to 4 w.t. % surfactant, preferably, the composition of the present invention comprises 0 to 2 w.t. % surfactant, more preferably, 0 to 1 w.t. % surfactant, even more preferably 0 to 0.85 w.t. % and most preferably 0 to 0.5 w.t. %. The composition can be completely free of non-emulsified surfactant (ie surfactant not used to emulsify the droplet).

The term surfactant covers all categories of surfactant, including: anionic, cationic, non-ionic and zwitterion surfactants. Many surfactants are traditionally used in laundry compositions: laundry detergent compositions often comprise anionic and non-ionic surfactants whereas fabric conditioning compositions often comprise cationic surfactants.

The composition is not a traditional laundry detergent or fabric conditioning composition. The present invention preferably comprises low levels or no surfactants. Any surfactant present is preferably for the purpose of emulsifying the silicone and not for detergency or softening.

Cationic Polymer

The serum preferably comprises a cationic polymer. This refers to polymers having an overall positive charge.

The cationic polymer may be naturally derived or synthetic. Examples of suitable cationic polymers include: acrylate polymers, cationic amino resins, cationic urea resins, and cationic polysaccharides, including: cationic celluloses, cationic guars and cationic starches.

The cationic polymer may be categorised as a polysaccharide-based cationic polymer or non-polysaccharide based cationic polymers.

Polysaccharide-Based Cationic Polymers:

Polysacchride based cationic polymers include cationic celluloses, cationic guars and cationic starches. Polysaccharides are polymers made up from monosaccharide monomers joined together by glycosidic bonds.

The cationic polysaccharide-based polymers present in the compositions of the invention have a modified polysaccharide backbone, modified in that additional chemical groups have been reacted with some of the free hydroxyl groups of the polysaccharide backbone to give an overall positive charge to the modified cellulosic monomer unit.

Non Polysaccharide-Based Cationic Polymers:

A non-polysaccharide-based cationic polymer is comprised of structural units, these structural units may be non-ionic, cationic, anionic or mixtures thereof. The polymer may comprise non-cationic structural units, but the polymer must have a net cationic charge.

The cationic polymer may consists of only one type of structural unit, i.e., the polymer is a homopolymer. The cationic polymer may consists of two types of structural units, i.e., the polymer is a copolymer. The cationic polymer may consists of three types of structural units, i.e., the polymer is a terpolymer. The cationic polymer may comprises two or more types of structural units. The structural units may be described as first structural units, second structural units, third structural units, etc. The structural units, or monomers, may be incorporated in the cationic polymer in a random format or in a block format.

The cationic polymer may comprise a nonionic structural units derived from monomers selected from: (meth)acrylamide, vinyl formamide, N, N-dialkyl acrylamide, N, N-dialkylmethacrylamide, C1-C12 alkyl acrylate, C1-C12 hydroxyalkyl acrylate, polyalkylene glyol acrylate, C1-C12 alkyl methacrylate, C1-C12 hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and mixtures thereof.

The cationic polymer may comprise a cationic structural units derived from monomers selected from: N, N-dialkylaminoalkyl methacrylate, N, N-dialkylaminoalkyl acrylate, N, N-dialkylaminoalkyl acrylamide, N, N-dialkylaminoalkylmethacrylamide, methacylamidoalkyl trialkylammonium salts, acrylamidoalkylltrialkylamminium salts, vinylamine, vinylimine, vinyl imidazole, quaternized vinyl imidazole, diallyl dialkyl ammonium salts, and mixtures thereof.

Preferably, the cationic monomer is selected from: diallyl dimethyl ammonium salts (DADMAS), N, N-dimethyl aminoethyl acrylate, N,N-dimethyl aminoethyl methacrylate (DMAM), [2-(methacryloylamino)ethyl]trl-methylammonium salts, N, N-dimethylaminopropyl acrylamide (DMAPA), N, N-dimethylaminopropyl methacrylamide (DMAPMA), acrylamidopropyl trimethyl ammonium salts (APTAS), methacrylamidopropyl trimethylammonium salts (MAPTAS), quaternized vinylimidazole (QVi), and mixtures thereof.

The cationic polymer may comprise a anionic structural units derived from monomers selected from: acrylic acid (AA), methacrylic acid, maleic acid, vinyl sulfonic acid, styrene sulfonic acid, acrylamidopropylmethane sulfonic acid (AMPS) and their salts, and mixtures thereof.

Some cationic polymers disclosed herein will require stabilisers i.e. materials which will exhibit a yield stress in the serum. Such stabilisers may be selected from: thread like structuring systems for example hydrogenated castor oil or trihydroxystearin e.g. Thixcin ex. Elementis Specialties, crosslinked polyacrylic acid for example Carbopol ex. 15 Lubrizol and gums for example carrageenan.

Preferably the cationic polymer is selected from; cationic polysaccharides and acrylate polymers. More preferably the cationic polymer is a cationic polysaccharide.

The molecular weight of the cationic polymer is preferably greater than 20 000 g/mol, more preferably greater than 25 000 g/mol. The molecular weight is preferably less than 2 000 000 g/mol, more preferably less than 1 000 000 g/mol.

Serum according to the current invention preferably comprise cationic polymer at a level of 0.25 to 10 w.t % of the formulation, preferably 0.35 to 7.5 w.t. % of the formulation, more preferably 0.5 to 5 w.t. % of the formulation Rheology Modifier In some embodiments of the present invention, the serum may comprise rheology modifiers. These may be inorganic or organic, polymeric or non polymeric. A preferred type of rheology modifiers are salts.

Other Ingredients

The products of the invention may contain pearlisers and/or opacifiers. It may further comprise other optional laundry ingredients.

Physical Characteristics

Preferably the viscosity of the laundry serum composition is greater than the viscosity of a laundry liquid with which it is used, more preferably 300 Pa·s, most preferably 500 Pa·s greater than a laundry liquid with which it is used. The higher viscosity prevents mixing of the laundry serum composition and laundry liquid and provides the benefit that the entire serum composition is carried into the wash or rinse with the laundry liquid.

The viscosity of the laundry composition is preferably 400-15000 Pa·s. This viscosity provides the benefit the laundry liquid carries the serum into the laundry process.

Preferably, the serum floats on a, laundry liquid with which it is used. By float it is meant that the serum will remain at the surface of the laundry liquid for a period of at least 5 minutes, preferably 10 minutes and most preferably at least 15 minutes. Floating provides the benefit the laundry liquid carries the serum into the laundry process.

To enable the serum to float, it is not essential that it is less dense than the laundry liquid with which it is being used, however it is preferred that the serum is less dense than the laundry liquid with which it is used. This density provides the benefit the laundry liquid carries the serum into the laundry process.

The laundry serum composition is preferably not miscible with a laundry liquid with which it is used. The immiscibility prevents mixing of the laundry serum composition and laundry liquid and ensures maximum performance of the serum.

Method of Delivery

One aspect of the present invention is a method of delivering the laundry serum composition into the wash or rinse cycle.

The method of delivering a laundry serum composition into the wash or rinse cycle, comprises the steps of:

a. Pouring a laundry liquid into a washing machine drawer, drum or a dosing shuttle
b. Pouring a laundry serum composition according to any preceding claim on top of the laundry liquid By drawer it as meant any one of the compartments in the washing machine drawer. By dosing ball is meant any form of container which would usually hold a laundry detergent composition and be placed directly in a washing machine.

Preferably a laundry liquid is poured into a washing machine drawer or a dosing ball, and then the serum is poured on top of the laundry liquid in the drawer or dosing ball.

Pouring the laundry serum on top of the laundry liquid provides the benefit that the laundry liquid carries the serum into the wash or rinse with mixing with the two compositions Preferably the serum is added to the laundry process in a volume of 2-50 ml, more preferably a volume of ml 2-30 ml, most preferably 2-20 ml.

Kit of Parts

Another aspect of the present invention, is a kit of parts comprising a laundry liquid and a laundry serum composition as disclosed herein. The laundry liquid and laundry serum being compatible with each other, as outlined in this description. The laundry liquid in the kit is a laundry detergent or a fabric conditioner/softener.

Preferably the kit of parts further comprises instructions on how to use the laundry serum with the laundry liquid, as disclosed herein.

EXAMPLES

Method of Preparing Example Laundry Formulations:

Water and hydrotropes were mixed together at ambient temperature for 2-3 minutes at a shear rate of 150 rpm using a Janke & Kunkel IKA RW20 overhead mixer. Salts and alkalis were added and mixed for 5 minutes prior to addition of surfactants and fatty acid. The mixture was exothermic and allowed to cool to <30° C. The deposition polymer[2] (when present), silicone emulsion[1] (when present) and any remaining components such as perfume, preservatives and dyes are added.

Method of Producing Example Serum:

Demineralised water was added to the silicone emulsion[1] and mixed for 15 mins at 250 rpm using a Janke & Kunkel IKA RW20 overhead mixer. The solid deposition polymer[2] was added slowly over the top and mix for further 20 mins increasing the rotor speed to effect visible bulk mixing.

TABLE 1

Example Compositions

| Ingredient | Laundry detergent with silicone (w.t. %) | Laundry detergent without silicone (w.t. %) | Serum Composition (w.t. %) |
|---|---|---|---|
| Glycerol | 3.5 | 3.5 | — |
| TEA | 1.25 | 1.25 | — |
| Citric acid | 1.0 | 1.0 | — |
| Neodol 25-7 | 4.75 | 4.75 | — |
| LAS acid | 4.0 | 4.0 | — |
| Fatty Acid | 0.7 | 0.7 | — |
| Lauryl ether sulphate - Sodium salt | 2.0 | 2.0 | — |
| Silicone[1] | 0.6 | 0 | 5 |
| Deposition polymer[2] | 0.3 | 0 | 2 |
| NaOH | to pH 8-8.5 | to pH 8-8.5 | to pH 7-8 |
| Minors | <5 | <5 | <5 |
| Water | to 100 | to 100 | to 100 |

Silicone[1]—Silicone added as a 30% emulsion ex. Wacker Silicone. The silicone comprised a carboxy group in a mid-chain pendent position.
Deposition polymer[2]—Ucare ™ polymer LR400 ex. Dow Comparison of Formulations:

A wash cycle was carried out using 6 (20 cm×20 cm) pieces of terry towelling and a polycotton ballast. The total wash load was 2.0 kg. The towelling was mixed with the ballast fabric in a random order before adding into a Miele front loading washing machine.

Detergent was added as follows:

Wash A: 100 g Laundry detergent with silicone

Wash 1: 100 g Laundry detergent without silicone and 10 g serum to the wash drawer The machine was programed to a standard 40° C. cotton cycle. The towelling swatches were line dried between wash cycles. 5 wash cycles were performed.

The towels were measured for softness using a Phabrometer® ex. Nu Cybertek, Inc.

TABLE 2

Softness measurements results

| | Average softness | Standard deviation |
|---|---|---|
| Pre-wash sample | 9.887 | 0.272 |
| Wash A | 9.654 | 0.155 |
| Wash 1 | 9.193 | 0.220 |

Despite having slightly lower levels of silicone and deposition polymer in Wash 1, the fabric is significantly softer.

The invention claimed is:

1. A method of delivering a laundry serum composition into a wash or rinse cycle, comprising the steps of:

a. pouring a laundry liquid into a washing machine drawer, drum or a dosing shuttle b. after pouring the laundry liquid into the washing machine drawer, drum or a dosing shuttle, pouring the laundry serum composition on top of the laundry liquid so as to result in the laundry serum composition floating on and being immiscible with the laundry liquid for at least 5 minutes;

wherein the laundry serum composition comprises:

a. 2-60 w.t. % benefit agent;

b. less than 4 w.t. % surfactant; and c. water.

2. The method according to claim 1, wherein the benefit agent comprises a material selected from the group consisting of: lubricant, free perfume, encapsulated perfume or a mixture thereof.

3. The method according to claim 1, wherein the laundry serum composition has a viscosity greater than the laundry liquid.

4. The method according to claim 1, wherein the density of the laundry serum composition is less than the laundry liquid.

5. The method according to claim 1, wherein 2-50 ml of the laundry serum composition is poured on top of a laundry liquid.

* * * * *